United States Patent [19]

Uppström

[11] Patent Number: 4,537,001

[45] Date of Patent: Aug. 27, 1985

[54] BUILDING ELEMENTS

[76] Inventor: Leif R. Uppström, P.O. Box 83, 154 00 Gnesta, Sweden

[21] Appl. No.: 496,816

[22] Filed: May 23, 1983

[51] Int. Cl.[3] ..... B44F 7/00

[52] U.S. Cl. ..... 52/311; 52/608; 273/157 R

[58] Field of Search ..... 273/156, 157 R; 52/311, 52/608

[56] References Cited

U.S. PATENT DOCUMENTS

| | | | |
|---|---|---|---|
| 955,194 | 4/1910 | Peacock | 273/157 R |
| 1,565,009 | 12/1925 | Nierodka | 273/157 R |
| 1,656,117 | 1/1928 | Joseph | 273/157 R |
| 1,657,736 | 1/1928 | Bishop | 273/157 R |
| 2,901,256 | 8/1959 | Way | 273/157 R |
| 3,107,918 | 10/1963 | Edlen | 273/157 R |

FOREIGN PATENT DOCUMENTS

| | | | |
|---|---|---|---|
| 1086344 | 9/1980 | Canada | 273/157 R |
| 953120 | 5/1949 | France | 273/157 R |
| 286891 | 3/1953 | Switzerland | 52/311 |
| 10776 | of 1891 | United Kingdom | 273/157 R |

OTHER PUBLICATIONS

Examiner's Figure 1, (British Patent No. 10,776).
Examiner's Figure 2, (Canadian Patent No. 1,086,344).

*Primary Examiner*—Henry E. Raduazo

[57] ABSTRACT

Building elements with matching side surfaces for fitting together to form constructions of varying shape, said building elements having the same length (L) and each having two opposite, equiform, flat, parallel end surfaces and at least three flat, rectangular side surfaces extending between said end surfaces to effect said matching of the side surfaces, the cross-sectional surfaces of the building elements each having a size which is a multiple of a triangular area of the size $a^2/2$, and the sides of the end surfaces having proportional lengths selected from the group a, $a\sqrt{2}$, $2a$ and $2a\sqrt{2}$ or a multiple thereof, "a" having a predetermined value, and the sides of the end surfaces defining proportional angles selected from the group 45°, 90°, 135° and 270°. The building elements are non-congruent and are nine in number divided into a first group of building elements with non-congruent cross-sectional surfaces consisting of a right-angled isosceles triangle, the equal sides each having a length a, a rectangle with sides a and $2a$ and a parallelogram with sides $a\sqrt{2}$ and $2a$, a second group of building elements with non-congruent cross-sectional surfaces consisting of a right-angled isosceles triangle, the equal sides each having a length $a\sqrt{2}$, a parallel trapezium with sides $a\sqrt{2}$, $2a$ and $2a\sqrt{2}$, and a symmetrical pentagon including with respect to the line of symmetry two parallel trapeziums having sides a, $a\sqrt{2}$, and a third group of building elements with non-congruent cross-sectional surfaces consisting of a right-angled isosceles triangle, the equal sides each having a length $2a$, a symmetrical pentagon including with respect to the line of symmetry two parallel trapeziums having sides $a\sqrt{2}$ and $2a$, and a symmetrical hexagon including with respect to the line of symmetry two parallelograms having sides $a\sqrt{2}$ and $2a$, the end surfaces of the first group of building elements each having a height a, the end surfaces of the second group of building elements each having a height $a\sqrt{2}$ and the surfaces of the third group of building elements each having a height $2a$.

5 Claims, 11 Drawing Figures

BUILDING ELEMENTS

The present invention relates to building elements of a predetermined number and at all times used in that number of making constructions of varying shape by fitting together matching side surfaces of the building elements. Each building element has the same length and each has two opposite, equiform, flat, parallel end surfaces and at least three flat, rectangular side surfaces extending between said end surfaces to define said matching side surfaces. The invention relates particularly to building elements forming parts of puzzles to be fitted together to form puzzle constructions or the like.

Known building constructions or sets of the type described have no, or only very limited ability to vary the cross-sectional shape of the construction. With building sets consisting of brick-like building elements to be fitted together side by side, variation of shape is so limited that their pedagogic use is limited to the point it is virtually without value since it presents only a limited degree of difficulty in combining the elements. Conventional puzzles comprising several similar or dissimilar building elements are usually designed to be fitted together in only one way and therefore interest is lost after being completed a few times. Canadian patent No. 1,086,344 relates to such a quadratic puzzle consisting of 12 pieces, two of which are congruent, and having irrational values about the periphery.

The object of the invention is to provide a minimal number of building elements while maximizing the number of shapes that can be produced therefrom. The building elements can be fitted together in many different ways and used for different purposes; i.e. for educational purposes, including pedagogic and test purposes, recreation, as well as for purely technical applications.

This is achieved according to the invention in that the cross-sectional surfaces of the building elements each has a size which is a multiple of a triangular area of the size $a^2/2$, and the sides of the end surfaces having proportional lengths selected from the group consisting of a, $a\sqrt{2}$, 2a and $2a\sqrt{2}$ or a multiple thereof, "a" having a predetermined value, and the sides of the end surfaces defining proportional angles selected from the group consisting of 45°, 90°, 135 ° and 270°; that the building elements are non-congruent and are nine in number, divided into a first group of building elements with non-congruent cross-sectional or end surfaces consisting of a right-angled isosceles triangle, the equal sides each having a length a, a rectangle with sides a and 2a and a parallelogram with sides $a\sqrt{2}$ and 2a, a second group of building elements with non-congruent cross-sectional or end surfaces consisting of a right-angled isosceles triangle, the equal sides each having a length $a\sqrt{2}$, a parallel trapezium with sides $a\sqrt{2}$, 2a and $2a\sqrt{2}$, and a symmetrical pentagon, including with respect to the line of symmetry two parallel trapeziums having sides a, $a\sqrt{2}$ and a third group of building elements with non-congruent cross-sectional or end surfaces (consisting of a right-angled isosceles triangle, the equal sides each having a length 2a, a symmetrical pentagon including with respect to the line of symmetry two parallel trapeziums having sides $a\sqrt{2}$ and 2a, and a symmetrical hexagon including with respect to the line of symmetry two parallelograms hving sides $a\sqrt{2}$ and 2a, the end surfaces of the first group of building elements each having a height a, the end surfaces of the second group of building elements each having a height $a\sqrt{2}$ and the surfaces of the third group of building elements each having a height 2a; and that the nine non-congruent building elements are arranged to be fitted together with said side surfaces adjacent each other to form constructions with cross-sectional surfaces of different shapes and of the same size, $20a^2$.

Preferred embodiments of the invention are defined in the sub-claims.

The invention will be described in the following with references to the drawings in which FIG. 1 shows a set of nine building elements in accordance with a preferred embodiment of the invention.

Figure 1:
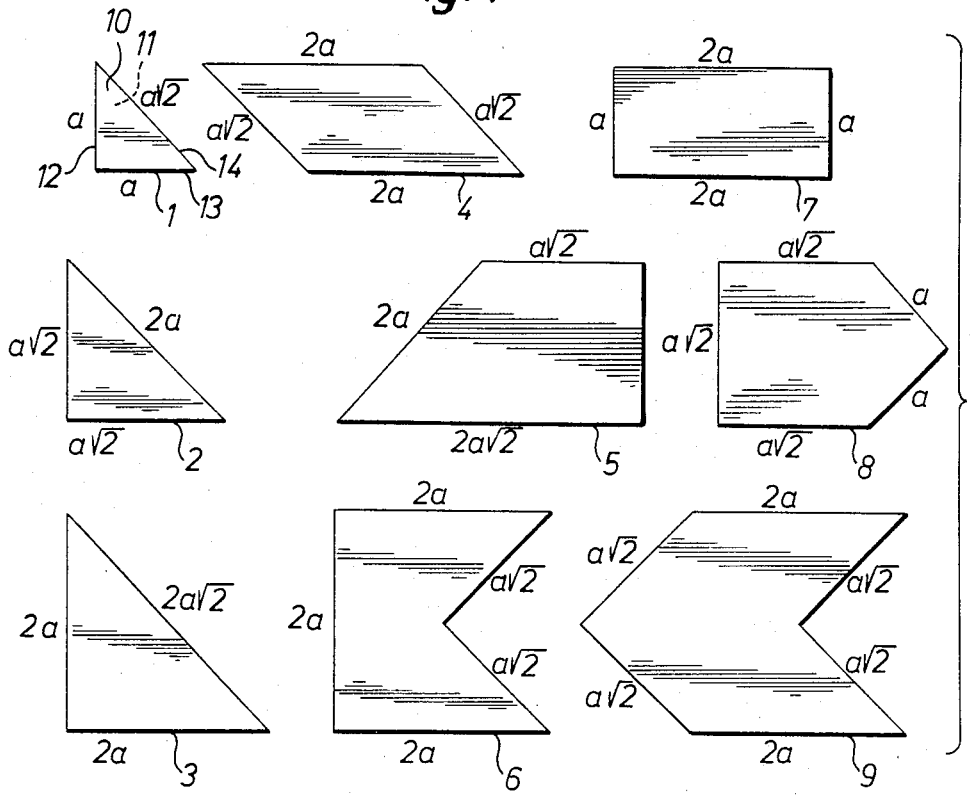

FIG. 1 shows a two-dimensional view of a set of nine building elements 1 to 9 with matching side surfaces, which are non-congruent in accordance with the present invention, i.e. they do not entirely cover each other when one element is laid on another element. Of the nine building elements, three comprise right-angled isosceles triangles 1, 2, 3 which constitute the basic elements in each group and which are of different sizes but mathematically related in that the smallest triangle 1 has one side with a length a and the largest triangle 3 has one side with a length 2a, while the intermediate triangle has one side with a length $a\sqrt{2}$, the hypotenuses thus being $a\sqrt{2}$, $2a\sqrt{2}$ and 2a, respectively, and the areas $a^2/2$, $2a^2$ and $a^2$, respectively, where "a" is a predetermined number of value depending on the proposed application of the building elements, e.g, 2 cm for a pedagogic puzzle. The other building elements 4 to 9 have different geometrical shapes such as a rectangle, parallelogram, parallel trapezium and symmetrical polygons. The latter consist of two parallel trapeziums mirrored on either side of the line of symmetry and the length of the straight sides being a function of a and the areas a multiple of a triangular area of the size $a^2/2$, as stipulated in FIG. 1. Symmetrical polygons are also included consisting of two parallelograms mirrored on either side of the line of symmetry, the length of the straight sides also being a function of a and the area being a multiple of a triangular area of the size $a^2/2$, as stipulated in FIG. 1. The building elements shown in FIG. 1 thus have the following areas: $a^2/2(1)$, $a^2(2)$, $2a^2(3)$, $2a^2(4)$, $3a^2(5)$, $3a^2(6)$, $2a^2(7)$, $(5a^2/2)(8)$ and $4a^2(9)$.

Figure 2:
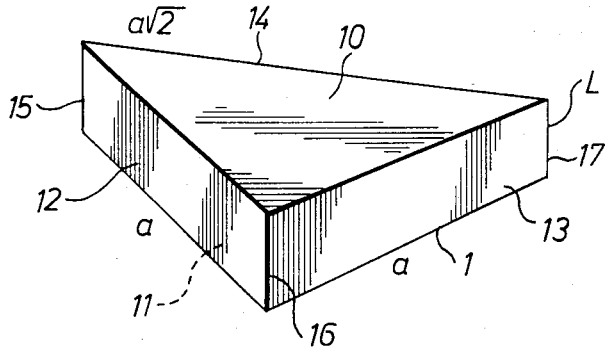
FIG. 2 shows a perspective view of one of the triangular building elements in accordance with FIG. 1.

FIG. 2 shows a building element 1 in perspective, having two opposite, equiform, flat, parallel end surfaces 10, 11 in accordance with the first triangle shown in FIG. 1, and three flat side surfaces 12, 13, 14, extending between said end surfaces and being perpendicular thereto. The side surfaces, i.e. the building element, have a predetermined length L which is chosen depending on the proposed field of application and which thus corresponds to the length of the side edges 15, 16, 17 at the junction with adjacent side surfaces. The two end surfaces 10, 11 are consequently congruent and located one on top of the other with their central points on a common vertical line. The building elements 1 to 9 comprising a set have a common dimension, i.e. the length L.

The end surfaces 10, 11 thus correspond to the smallest triangle in FIG. 1 and the side surfaces 12, 13 forming right-angles with each other have a breadth a, while the third side surface has a breadth of $a\sqrt{2}$.

The building elements thus have edges forming straight lines which have a strict mathematical relation to each other following the series a, $a\sqrt{2}$, 2a and $2a\sqrt{2}$ or a multiple thereof.

All non-congruent building elements included in the set are intended to be fitted together to form different construction with cross-sectional areas which are thus of the same size, i.e. $20a^2$.

Figure 3:
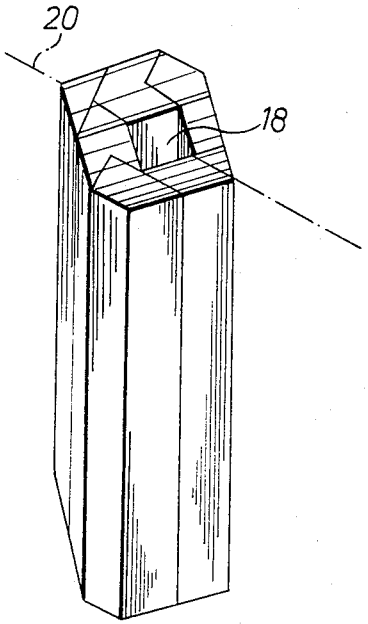
FIG. 3 shows a column-shaped construction of the building elements in accordance with FIG. 1.
Figure 4:
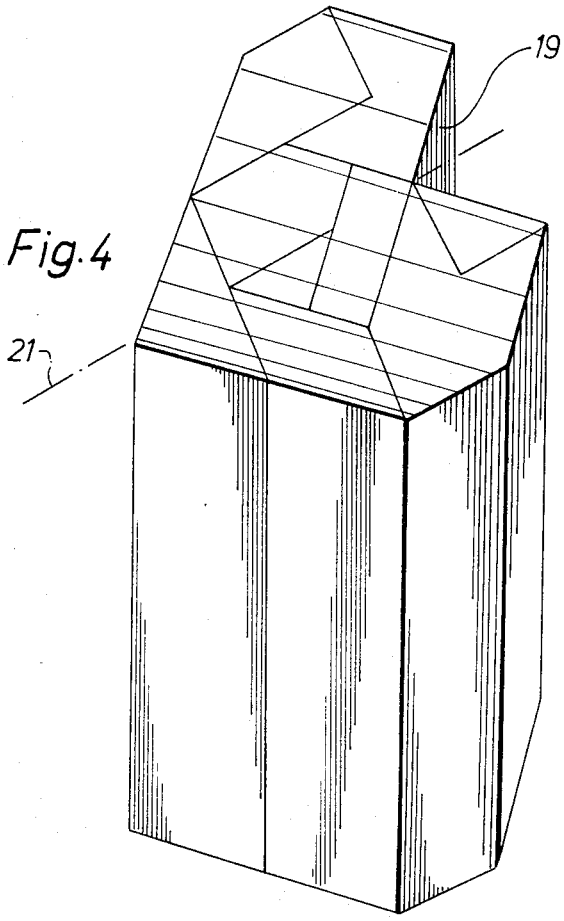
FIG. 4 shows a column-shaped construction of building elements in accordance with FIG. 1, in which the cross-section of the column has a different shape from that shown in FIG. 3.

FIGS. 3 and 4 show two different constructions produced from building elements in accordance with FIGS. 1 and 2. Both are in the shape of a column, the one in FIG. 3 having been made with a hole 18 running through it and the one in FIG. 4 with a longitudinal recess 19. The building elements may have surface contact only along the flat surfaces or they may be adhered at the contact surfaces, e.g. with a binder. Besides an aesthetic effect obtained from the two columns, which may be used in load-bearing, visible building constructions, the hollow 18 in the column shown in FIG. 3 may be used for laying cables of various types. A characteristic feature of the set of building elements according to the present invention is that the elements can be combined or joined together to form building constructions which are symmetrical about a longitudinal central plane 20 and 21, respectively, as indicated in FIGS. 3 and 4.

Figure 5:
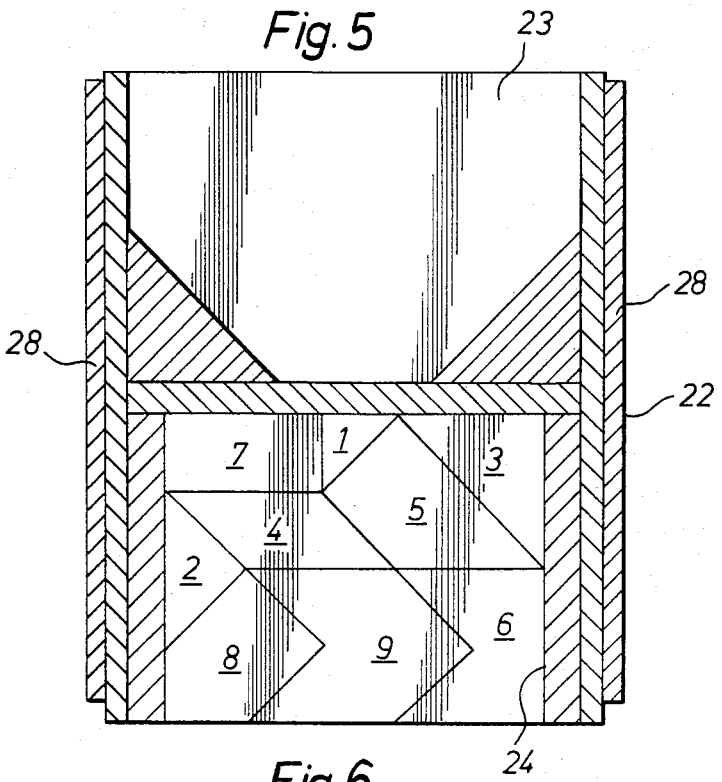
FIG. 5 shows a box in cross-section, which can be used together with the building element according to the invention.
Figure 6:
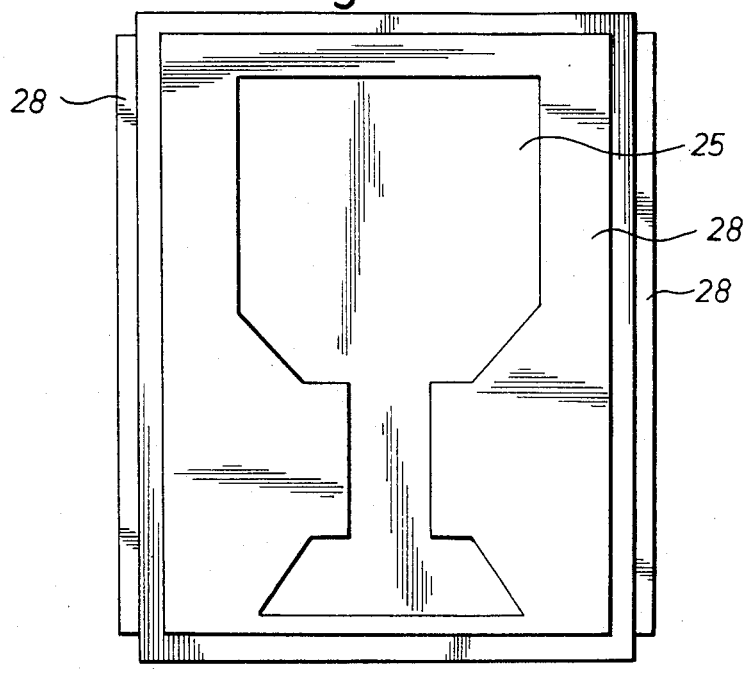
FIG. 6 shows an embodiment of one of the sides of the box according to FIG. 5 where the sides have been provided with recesses to receive the end parts of the building elements.
Figure 7:
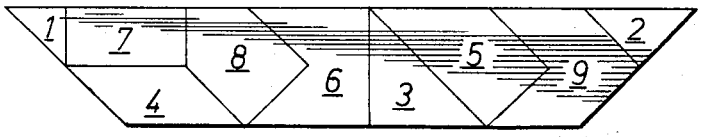
FIGS. 7–11 show different polygons which can be produced from the new puzzle bits in accordance with FIG. 1.
Figure 8:
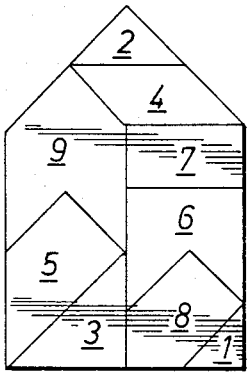
Figure 9:
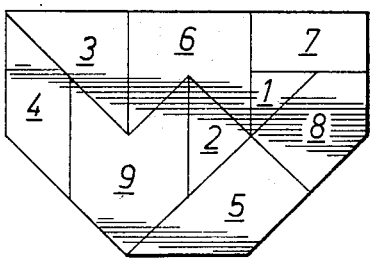
Figure 10:
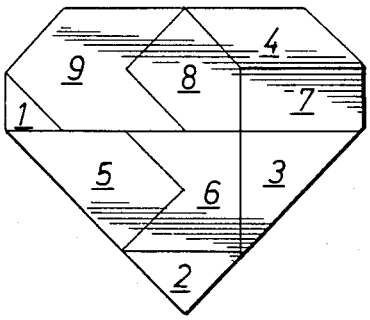
Figure 11:
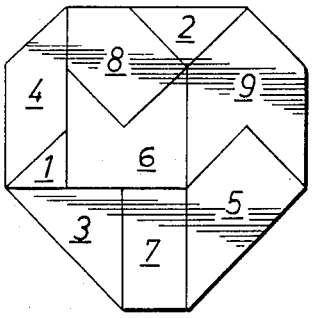

The set of building elements according to the invention can also be used for pedagogical purposes or similar problems to place the elements included in a puzzle next to each other to form predetermined constructions, e.g. a heart, the number three, rectangles, etc. having cross-sectional areas of the same size, i.e. $20a^2$. According to a particular embodiment the system also includes a building box or similar puzzle support having one or more spaces and recesses to partially or entirely receive the building elements. One such application is illustrated in FIGS. 5 and 6 FIG. 5 of which showing a cross-section of a building box 22, comprising two cavities 23, 24, accessible at opposite ends of the box, the cavities having cross-sections of the same size but different shapes to be completely filled by all the building elments 1 to 9 so that some of their side surfaces will be in the same plane as the end of the building box, as illustrated for one of the solutions. The building box is also provided with recesses 25 in its four side sections 28, which may differ in contour, the differently-shaped recesses having cross-sectional areas (bottom areas) of the same size and each having the same cross-section area as the combined building elements together to receive the end sections of the building elements to give external column constructions having the predetermined cross-sectional area ($20a^2$).

As is clear from FIG. 1, the set shown there comprises three different groups of building elements, the elements in each group having end surfaces with a common dimension, i.e. a first group with the dimension a, a second group with the dimension $a\sqrt{2}$ and a third group with the dimension 2a, which dimension in each case represents the height of the end surfaces seen in accordance with FIG. 1.

The combined building constructions can be used in various ways thanks to the great variety of shapes which can be produced from building elments from one and the same set, e.g. by forming the elements loosely or permanently to columns with predetermined cross-sectional or end surfaces as described above, e.g. for objects made in carpentry such as pedestals, lamp-holders, or to serve as pressure-absorbing columns in load-bearing constructions in which the cross-sectional areas should be constant for reasons of strength, but where variations in the geometry of the cross-section provide a functional and/or decorative effect. Besides the purely pedegogical application of solving given construction problems, the building elements can be used in toys, e.g. being included as parts in a building box. The elements may be made of wood, plastic or any other suitable material.

The choice of geometry involving modules or building elements with non-congruent cross-sectional or end surfaces is the general result of a compromise between attaining the greatest possible opportunity for combining the modules to symmetrical cross-sections and the least possible number of cuts in the cross-section in order to achieve optimum economy. The number of strip-shaped building elements of different type is limited and the strips can be produced in large quantities in standard design. The simplicity of the building sets of building elements enables production of such sets in an easy way and for various purposes, giving inexpensive products to be used with simmple instruction figures, which the consumer can easily put together himself. Asymmetric cross-sections can also be achieved when combining the elements, but for reasons of stability symmetrical ones are preferable for load-bearing constructions.

In a particularly preferred embodiment of the invention, the nine building elements described above form puzzle bits in a puzzle having varying outer contours. Since the puzzle bits are non-congruent and have surfaces which increase in a high degree, have specified angles and are divided into three different groups with specified geometric figures of defined type, the puzzle bits can be fitted together to numerous different final shapes. These conditions are not previously known and thus neither are the stated ways of putting them together. The result is a completely original and unique puzzle. Furthermore, the puzzle with the nine bits has a rationally dimensioned circumference which considerably facilitates the manufacture.

The invention relates to puzzle bits which can be fitted together to form a plurality of symmetrical figures which can only be achieved by varying the combination of the nine defined puzzle bits. It is thus possible to form a regular St. Andrew's cross or a Greek cross. In this case the surface must be evenly divisible by five since the cross may be considered as the sum of five squares of equal size. It is also possible to form symmetrical pentagons, hexagons and octagons as well as numerous symmetrical figures with or without cavities, which it has been impossible to construct previously with so few puzzle bits, without departing from the requirement of non-congruence and covering an area of 20 $a^2$, where "a" is the side length of each of the short sides in the smallest triangle, and the permitted angles. As will be understood (from the value $20a^2$), the puzzle bits according to the invention cannot be used to form a square.

Thus, the invention fulfils the object to attempt a cover as large an area as possible with variation in size and shape of the bits in order to obtain the greatest possible opportunity for combination, with as few bits as possible. The result is completely surprising and could not in any way have been predicted from known puzzles. The puzzle bits combined and constructed in accordance with the invention, and the puzzle shapes produced therewith thus differ from all previously known building sets. The combination of the geometric requirements, strict side and angle requirements, the series-increase in size of the bits, non-congruence, rationality of the circumference of the basic form and combination possibilities to a great number of different symmetrical building constructions or figures with a few bits, as defined in accordance with the invention, makes the invention entirely original and unique in comparison with known technique. As can be seen in FIG. 7 to 11, the puzzle bits according to the invention can be combined to form polygons with 4, 5, 6, 7 or 8 corners, all of which are convergent and symmetrical, giving further evidence of the originality of the invention.

What I claim is:

1. Building elements of predetermined number with matching side surfaces for fitting all of the predetermined number of building elements together to form construction of varying shape, each said building elements having the same length (L) and each having two opposite, equiform, flat, parallel end surfaces and at least three flat, rectangular side surfaces extending between said end surfaces thereby to present said matching side surfaces, the cross-sectional surfaces of the building elements each having a size which is a multiple of a triangular area of the size $a^2/2$, and the sides of the end surfaces having proportional lengths selected from the group consisting of a, $a\sqrt{2}$, 2a and $2a\sqrt{2}$ or a multiple thereof, "a" having a predetermined value, and the sides of the end surfaces defining proportional angles selected from the group consisting of 45°, 90°, 135° and 270°, said building elements to form said varying shape constructions being non-congruent, having non-congruent matching side surfaces and being always a nine in number said nine building elements being divided into three groups, a first group comprising a right-angled isosceles triangle, the equal sides of which each has a length a, a rectangle with sides a and 2a and a parallelogram with sides $a\sqrt{2}$ and 2a, a second group comprising a right-angled isosceles triangle, the equal sides of which each has a length $a\sqrt{2}$, a parallel trapezium with sides $a\sqrt{2}$, 2a and $2a\sqrt{2}$, and a symmetrical pentagon defining with respect to its line of symmetry two parallel trapeziums having sides a, $a\sqrt{2}$, the third of said three groups of building elements comprising a right-angled isosceles triangle, the equal sides of which each has a length 2a, a symmetrical pentagon defining with respect to its line of symmetry two parallel trapeziums having sides $a\sqrt{2}$ and 2a, and a symmetrical hexagon defining with respect to its line of symmetry two parallelograms having sides $a\sqrt{2}$ and 2a, the end surfaces of the first group of building elements each having a height a, the end surfaces of the second group of building elements each having a height $a\sqrt{2}$ and the end surfaces of the third group of building elements each having a height 2a, all of said nine non-congruent building elements always being fitted together with predetermined of said side surfaces adjacent each other to form constructions of various shapes of varying cross-section but of the same area, $20a^2$.

2. Building elements according to claim 1, wherein they are combined with a box-shaped support means having at least one cavity, having a dimension corresponding to the length (L) of the building elements and a cross-sectional area, at right angles to said dimension corresponding to the length (L), the cross-sectional area of the support means corresponding to the total cross-sectional area of the building elements, said cavity being completely filled by the nine building elements when these are placed correctly in relation to one another in the cavity.

3. Building elements according to claim 2, wherein said support means is provided with outer wall sections having recesses of different shapes in relation to each other, the cross-sectional area of said recesses being equal in size and having the same cross-sectional area as the total cross-sectional area of the nine building elements, each recess being arranged to be completely filled by end portions of the building elements when these are placed correctly in relation to one another in the recess.

4. Building elements according to claim 1, wherein said parallel trapezium of said second group is an asymmetric trapezium.

5. Building elements according to claim 1, wherein an odd number of asymmetric element is provided amongst said nine building elements.

* * * * *